United States Patent [19]

Hayba

[11] Patent Number: 4,505,335

[45] Date of Patent: Mar. 19, 1985

[54] FIRE EXTINGUISHER HANDLE SECURING APPARATUS

[75] Inventor: Franklin P. Hayba, Cleveland, Tenn.

[73] Assignee: ASP International, Inc., Cleveland, Tenn.

[21] Appl. No.: 440,987

[22] Filed: Nov. 12, 1982

[51] Int. Cl.[3] ..... A62C 13/24

[52] U.S. Cl. ..... 169/76; 222/402.15; 222/473

[58] Field of Search ..... 169/30, 76, 89; 239/375, 525, 526; 222/402.11, 402.13, 402.15, 473, 474

[56] References Cited

U.S. PATENT DOCUMENTS

| | | | |
|---|---|---|---|
| 2,715,481 | 8/1955 | McGhie et al. | 222/402.13 |
| 3,506,159 | 4/1970 | Müller | 222/402.13 |
| 3,938,710 | 2/1976 | Bennett | 222/402.11 |
| 4,245,759 | 1/1981 | Baker et al. | 222/473 |
| 4,277,004 | 7/1981 | Barlics | 222/402.13 |
| 4,432,474 | 2/1984 | Hutchinson et al. | 222/402.15 |

FOREIGN PATENT DOCUMENTS

| | | | |
|---|---|---|---|
| 2270008 | 12/1975 | France | 222/402.13 |
| 2406765 | 6/1979 | France | 169/89 |
| 2039735 | 8/1980 | United Kingdom | 169/30 |

*Primary Examiner*—Jeffrey V. Nase
*Assistant Examiner*—Michael J. Forman
*Attorney, Agent, or Firm*—Jerry W. Mills; Gregory M. Howison; Nina L. Medlock

[57] ABSTRACT

An aerosol fire extinguishant container has an insert positioned and secured within a recess in the closure cap of the container. An opening in the insert permits the stem of a depressable ejector nozzle to engage a valve structure in the cap. A trigger is pivotably mounted within a handle mounted on the cap and has a cam for acting on the ejector nozzle to release extinguishant through the nozzle when the trigger is depressed. The insert has strengthening bars which aid in securing the handle to the cap. The insert prevents the stem of the nozzle from being separated from the valve structure when the container is dropped and the handle and trigger are broken.

11 Claims, 3 Drawing Figures

FIRE EXTINGUISHER HANDLE SECURING APPARATUS

BACKGROUND OF THE INVENTION

This invention relates to fire extinguishers and more particularly to the mounting of the actuator and handle to the container of a fire extinguisher.

In the conventional trigger actuated aerosol type fire extinguishing containers, a nozzle type ejector is disposed into a spring biased valve opening in a crimped cap on the top of the container, and the trigger, which is mounted within a handle structure, is depressable to overcome the spring pressure to release and discharge the extinguishant. Conventional units, for cost reduction purposes, comprise plastic material with the exception of the extinguishant container per se. One recent safety certification test of such extinguishers is to maintain the unit at −40 degrees F. for 24 hours, then to drop test the unit from an elevation of approximately three feet, and thereafter to determine the ability of the unit to discharge the extinguishant. Such conventional units have been unsuccessful when so tested since the plastic handle becomes excessively brittle when exposed to such low temperature environments for the period of time involved, and when dropped, the handle and trigger break causing the ejector stem to be pulled out of the valve. Of course, once the ejector unit is detached, the extinguishant can not be discharged.

SUMMARY OF THE INVENTION

Consequently, it is a primary object of the present invention to provide a fire extinguisher in which the ejector nozzle will remain intact in the valve structure so that the extinguishant can be discharged even after rigorous certification testing.

It is another object of the present invention to provide an aerosol fire extinguisher having a trigger actuated discharge ejector nozzle mounted within a handle structure secured to the extinguisher container, which when dropped from various attitudes after extensive low temperature static conditions will not result in the ejector being separated from the valve structure.

It is a further object of the present invention to provide in an aerosol fire extinguisher having a trigger actuated valve, the trigger being supported by a handle, a support member for strengthening the connection between the ejector nozzle and the valve mechanism of the extinguisher container so that separation of the ejector nozzle from the container is precluded even if the handle and trigger are broken away from the container.

It is a still further object of the present invention to provide an insert secured to the valve supporting cap of an aerosol fire extinguisher, the insert having an ejector receiving opening for permitting engagement of the ejector stem with the valve to overcome the normally closed bias thereof and which strengthens the connection between a handle and the container cap, the handle carrying a trigger for engaging the ejector to open the valve, the insert acting to prevent separation of the ejector even when the handle and trigger are broken away from the cap.

In accordance with the principles of the present invention an aerosol container of fire extinguishant has an insert disposed for supporting the ejector nozzle while allowing the ejector nozzle to actuate a discharge valve disposed within the cap of the container, the ejector nozzle being manually actuated by a trigger command against the ejector and disposed within a handle structure. The handle structure and trigger are plastic material and if broken the ejector nozzle could still release the valve and allow the extinguishant to be discharged since the insert prevents separation of the ejector nozzle from the valve structure.

The insert is positioned and secured within a recess in the closure cap of the container which is crimped onto the container, the crimp forming a bead. The insert has an annular groove facing substantially opposite the bead, and epoxy or a similar solidifying bonding material is disposed in the recess and forms an annular ring in the void between the groove and the bead. Preferably, the insert also includes a pair of spaced strengthening bars which rest on the handle and act to strengthen the connection between the handle structure and the top of the container and cap.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
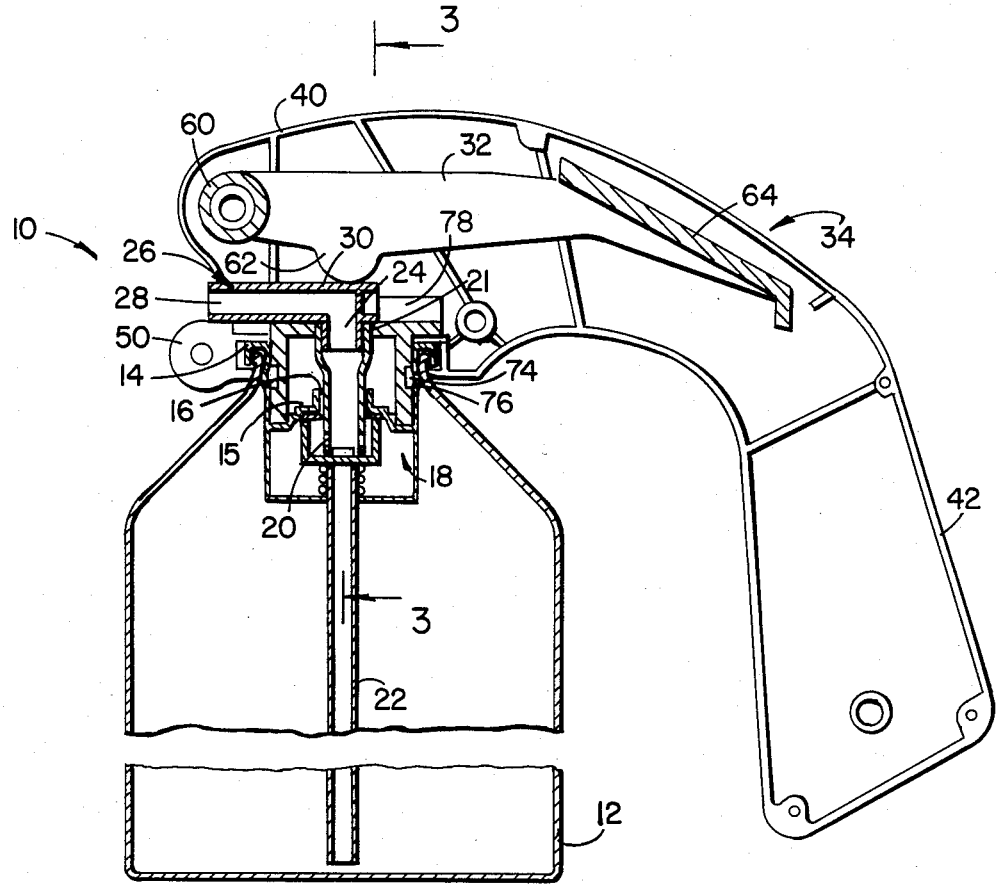
FIG. 1 is a cross sectional view taken substantially vertically through an aerosol fire extinguisher incorporating the principles of the present invention.
Figure 3:
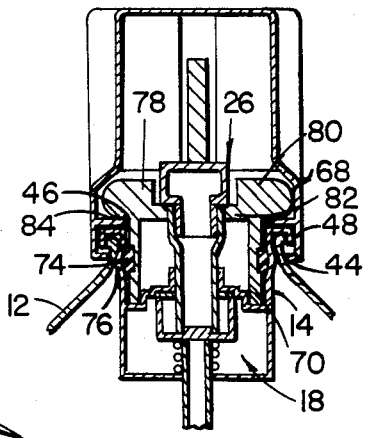
FIG. 3 is a vertical cross sectional view taken substantially along line 3—3 of FIG. 1.
Figure 2:
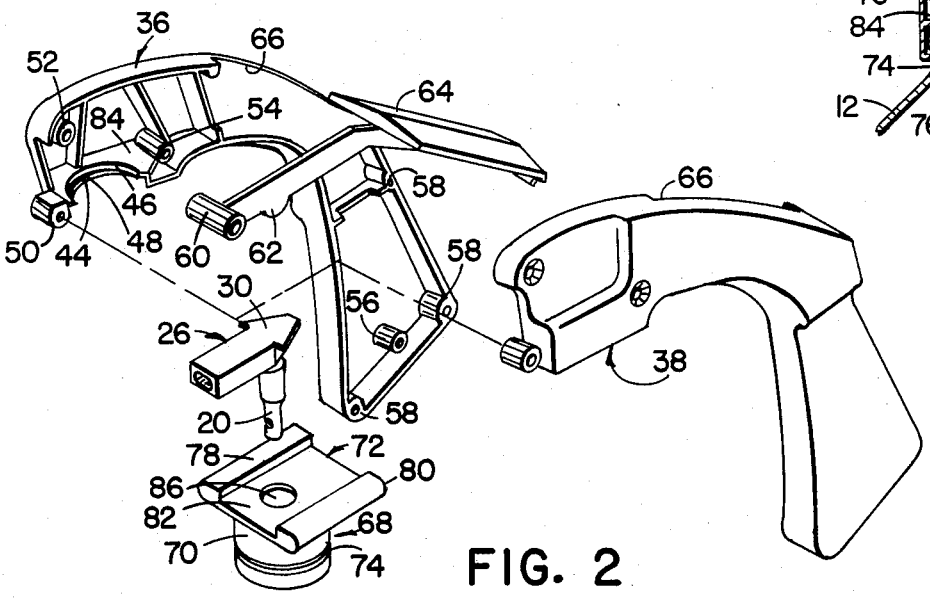
FIG. 2 is a disassembled perspective view of the extinguishant discharge elements disposed on and about the closure cap of the extinguisher illustrated in FIG. 1.

Referring now to the drawings, FIG. 1 illustrates a fire extinguisher generally at 10 comprising a metallic container 12 which may be filled with an extinguishant under relatively high pressure and closed at the top with a closure cap 14 preferably of metallic material crimped onto the container. The cap 14 includes a recess 15 in the center of which an opening 16 is formed and fitted with a biased valve structure generally indicated at 18. The structure is conventional and conventionally will receive the lower end of a hollow stem 20 directly into the opening 16 for acting on one side of the valve structure, the other side of the valve structure being provided with an elongated tube 22 extending to adjacent the bottom of the container. An enlarged upper end 21 of the stem 20 communicates with an opening 24 in the bottom of a nozzle 26, the opening communicating with the nozzle outlet channel 28. The extinguishant may be released by depression of the tab 30 at the closed end of the nozzle, only a portion of the tab is illustrated in the drawings since the remainder thereof is removed for utilization of the same member when modified for purposes of the present invention. When the tab is depressed, the stem 20 depresses and overcomes the bias of the valve spring and allows the extinguishant to be released from the tube 22 through the valve into the stem 20 and out of the nozzle outlet channel 28.

A more convenient release of the extinguishant is obtained by means of a plastic trigger mechanism 32 mounted within a plastic handle 34. The handle comprises two parts 36 and 38 which mate one to the other and pivotably carry the trigger mechanism. The handle has an upper portion 40 sloping downwardly to a hand-held portion 42 of a convenient shape spaced from the upper end of the container. The two handle parts 36 and 38 are substantially the same and as illustrated on part 36 each comprises a wall portion having a semi-circular opening 44 of a diameter slightly larger than the outer portion of the cap 14 for mounting about the cap. Each semi-circular opening 44 has a similar opening 46 in a wall above the opening 44 of substantially the same diameter as the top of the cap and spaced from the opening 44 by the amount that the cap extends above the container proper. A slot 48 is formed between the walls defining the openings 44 and 46 for entrapping the top of the cap 14 therebetween. A number of lugs 50, 52,54,56 are formed on each handle part 36, 38, the lugs 50, 52 and 54 each having an aperture extending therethrough for receiving fasteners such as screws and nuts (not illustrated). The lug 56 on the part 36 has an aperture extending partly therethrough for receiving a peg (not illustrated) molded onto the part 38. A number of similar lugs such as illustrated at 58 may be formed at various locations about the peripheral edge of the part 36 for receiving aligned pegs on the part 38 for proper mating of the handle parts.

The trigger mechanism 32 is a lever member having a hollow lug 60 at one end larger than, and disposed about, the lugs 52 so as to be pivotably mounted thereon. A cam surface comprising a small protuberance 62 extends from the bottom of the trigger lever to overlay and rest on the tab 30. The end of the trigger lever 22 remote from the lug 60 has a finger engaging tab 64 accessable through an opening 66 formed in each handle part 36, 38 at the top thereof adjacent the sloping portion. Thus, depression of the tab 64 depresses the tab 30 to release extinguishant.

The structure so far described in conventional, but does not pass the low temperature/drop test described above. When the unit is dropped the handle and trigger tend to break and the stem 20 and nozzle 26 are pulled out of the opening 16, probably due to the lugs 50 forcibly acting against the outlet end of the nozzle. The present invention overcomes this problem by providing an insert 68 disposed in the recess 15.

The insert 68 comprises a lower cylindrical portion 70 and an upper substantially rectangular portion 72, the two portions being preferably integrally formed from a plastic material such as a super tough nylon. The cylindrical portion 70 has an exterior diameter substantially equal to that of the interior diameter of the recess 15 of the cap 14 so that it may be positioned therein and the height of the cylindrical portion is substantially equal to the depth of the recess. An undercut groove 74 is formed about the periphery of the cylindrical portion 70 substantially at the location of the annular indented bead 76 formed in the cap 14 by the crimping process. A conventional epoxy bonding agent, or similar bonding material is utilized to secure the insert to the cap 14. The epoxy is placed between the cylindrical portion and the recess, and fills in the void between the bead 76 and the groove 74. Thus, when the epoxy cures and hardens an annular ring of epoxy is formed in this void which locks the insert to the cap. In fact, once cured, the annular epoxy ring acts as a locking member even if the bond between the cap and the insert fails, i.e. it provides a mechanical interference between the parts and prevents separation. The upper rectangular portion has a pair of raised substantially parallel strengthening ribs or bars 78, 80 spaced across the central section 82. Each bar 78, 80 extends away from the other bar beyond the periphery of the cylindrical portion 70, and at one end of the central section 82 the central portion and both bars project beyond the periphery of the cylindrical portion toward the portion 42 of the handle. Thus, each bar is of a size and disposition for being positioned on and to act against the respective wall 84 within which the semicircular opening 46 is formed. Thus, the bars 78,80 aid in strengthening the connection between the handle and the container when the handle parts 36, 38 are fastened together. In addition the handle may be bonded or glued to the top of the cap 14 by use of epoxy or the like placed within the slot 48.

Disposed through the central section 82 and through the cylindrical portion 70 is a through bore 86 for receiving the hollow stem 20 including the enlarged upper part 21 so that the stem 20 extends into the opening 60 for acting on the valve structure 18. The tab 30 at the rear of the nozzle may be formed such as to fit within the space between the bars 78, 80 or, as illustrated, the conventional nozzle may have a portion of the tab 30 removed so as to fit inside the space.

With this construction the trigger still acts upon the actuated tab 30 to dispense the extinguishant in the normal manner. However, since the connection between the actuator stem 20 is strengthened by the insert, the stem is not pulled out of the valve structure or opening 16 when the handle is broken including the trigger, and the tab 30 may still be depressed to release extinguishant. Moreover, since the insert also strengthens the connection between the handle and the container cap, and thus the container, there is less likelihood of the handle pulling the nozzle away from the container when the handle is broken. Thus, certification of the unit has been obtained by the construction.

Numerous alterations of the structure herein disclosed will suggest themselves to those skilled in the art. For example, it is envisioned that rather than having a separate insert such as illustrated in the preferred embodiment, the nozzle, stem and insert may be formed as a unitary member. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a fire extinguisher having a container for storing an extinguishant under pressure, said container including a closure cap fastened on the top thereof having an annular recess, said cap including valve means normally biased to prevent discharge of extinguishant from the container and through which extinguishant is discharged when the valve is open, an elongated discharge nozzle having a discharge end, a conduit connected to said nozzle spaced from the discharge end for communicating said nozzle with said valve means for communicating extinguishant discharged from said valve means through said nozzle, said conduit being depressable into engagement with said valve means for overcoming the bias and for urging said valve means to open, a handle mounted on said container with a trigger lever pivotably carried integral therewith and having cam means for acting on said nozzle to urge said conduit to open said valve means, the improvement comprising:

a support member disposed in the annular recess of said cap and extending above said cap;

said support member including means interfaced with said handle to prevent upward movement relative to said support member;

said support member having a base formed therein for allowing said conduit to pass therethrough and interact with said valve means;

a first annular groove defined on a surface of said annular recess and extending radially outwards;

a second annular groove defined on the surface of said support member and extending radially inwards, said second groove disposed such that it is proximate said first groove when said support member is disposed within said annular recess; and an annular ring formed in the space defined by said first and second groove to prevent upward movement of said support member relative said annular recess.

2. In a fire extinguisher as recited in claim 1, wherein said handle includes wall means disposed in engagement with the top of said cap, the means interfacing said support member with said handle comprising ribs at the top of said support member abutting said wall means.

3. In a fire extinguisher as recited in claim 1, wherein said closure cap is a substantially cylindrical member with said first annular groove formed in the wall defining said recess, and said support member comprises a cylindrical portion disposed in substantially abutting relationship with said wall, said cylindrical portion having said second annular groove disposed substantially opposite said first annular groove to define a void therebetween with said annular ring disposed in said void for locking said support member to said cap.

4. In a fire extinguisher as recited in claim 3, wherein said handle includes wall means disposed in engagement with the top of said cap, said support member comprising ribs at the top thereof abutting said wall means for aiding in securing said handle to said cap.

5. In a fire extinguisher as recited in claim 4, wherein said support member is an insert disposed between said cap and said nozzle.

6. In a fire extinguisher as recited in claim 5, wherein there are two spaced apart ribs, and said bore is intermediate said ribs.

7. In a fire extinguisher as recited in claim 3, wherein said annual ring comprises a substantially non-deformable material.

8. In a fire extinguisher as recited in claim 7, wherein said material comprises hardened epoxy.

9. A fire extinguisher, as recited in claim 1, wherein said elongated discharge nozzle comprises an elongated rectangular member having a bore formed therein along the longitudinal axis thereof, said bore communicating with the exterior on one end through a discharge port and with the exterior at the other end through an inlet port disposed at right angles to the longitudinal axis of said bore for communication with said conduit, said longitudinal member having a nipple disposed adjacent said inlet port with a passageway therethrough, said nipple inserting into said conduit for allowing attachment of said conduit to said nipple.

10. A fire extinguisher, as recited in claim 9, wherein said conduit comprises a hollow cylindrical member for attachment at one end to said nipple, said nipple slideably inserted therein, said cylindrical conduit mounted at right angles to the longitudinal axis of the bore in said elongated rectangular member.

11. A fire extinguisher, as recited in claim 10, wherein said support member comprises a cylindrical member for insertion into the annular recess of said container and having a flat surface on one end thereof disposed perpendicular to the longitudinal axis of said cylindrical member, said flat surface having a hole disposed therein for receiving and restraining lateral movement of said conduit, said elongated rectangular member disposed proximate the flat surface of said cylindrical member with its longitudinal axis parallel to said flat surface and in close proximity thereto, forceable removal of said handle not affecting said nozzle as said conduit is secured by said support member.

* * * * *